US006181246B1

(12) United States Patent
Ewing et al.

(10) Patent No.: US 6,181,246 B1
(45) Date of Patent: Jan. 30, 2001

(54) LUGGAGE ALARM

(76) Inventors: Priscilla L. Ewing; William A. Ewing, both of 4035 Parthenia Ave., Louisville, KY (US) 40215

( * ) Notice: Under 35 U.S.C. 154(b), the term of this patent shall be extended for 0 days.

(21) Appl. No.: 09/286,010

(22) Filed: Apr. 5, 1999

(51) Int. Cl.[7] ..... G08B 13/14
(52) U.S. Cl. ..... 340/571; 340/539; 340/568.7
(58) Field of Search ..... 340/571, 568.7, 340/545.6, 546, 539, 574

(56) References Cited

U.S. PATENT DOCUMENTS

| | | | | |
|---|---|---|---|---|
| 4,080,595 | * | 3/1978 | Rosen | 340/571 |
| 4,755,802 | * | 7/1988 | Urbanczyk | 340/571 |
| 4,804,943 | * | 2/1989 | Soleimani | 340/571 X |
| 5,043,702 | * | 8/1991 | Kuo | 340/539 |
| 5,126,719 | | 6/1992 | DeSorbo | 340/571 |
| 5,148,150 | | 9/1992 | White et al. | 340/571 |
| 5,164,706 | | 11/1992 | Chen | 340/571 |
| 5,493,274 | | 2/1996 | Long | 340/568.6 |
| 5,510,768 | | 4/1996 | Mann | 340/571 |
| 5,661,456 | | 8/1997 | Staehle, Jr. | 340/568.7 |
| 5,790,028 | * | 8/1998 | Lee | 340/571 |
| 5,977,876 | * | 11/1999 | Coleman | 340/571 |

* cited by examiner

*Primary Examiner*—Thomas Mullen
(74) *Attorney, Agent, or Firm*—Kenneth L. Tolar

(57) ABSTRACT

An alarm for a travel bag includes a casing attached to the bag having a receptacle thereon for receiving the bag zipper tongue. A locking device locks the tongue within the receptacle while simultaneously providing power to an alarm circuit. The alarm circuit includes a switch that moves to an open position upon the tongue being inserted into the receptacle. If the tongue is removed, the switch closes activating an audible alarm and a wireless transmitter. The transmitter transmits a signal to a remote unit likewise having an audible alarm. The remote unit further includes an activation button allowing a user to remotely activate or deactivate the alarm.

7 Claims, 3 Drawing Sheets

LUGGAGE ALARM

BACKGROUND OF THE INVENTION

The present invention relates to a theft preventive device, and more particularly an alarm for a travel bag or backpack, that emits an audible alarm if an unauthorized person tampers with the bag zipper.

DESCRIPTION OF THE PRIOR ART

A wide variety of theft prevention devices exist in the prior art for purses, backpacks, and suitcases. One such example is U.S. Pat. No. 5,661,456, issued to Staehle which discloses a keypad attached to the outer surface of a purse. When the purse is shut, an individual must enter a predetermined numerical code into the keypad, at which the time the keypad will transmit an access signal for a predetermined period of time, allowing the purse to be opened. Control circuitry within the purse will activate an alarm if an unauthorized individual attempts to open the purse. The purse also contains an external "panic button" for manually activating the alarm.

U.S. Pat. No. 5,510,768, issued to Mann, discusses an adjustable strap for wrapping around a piece of luggage. The strap includes an alarm in communication with an electrically conductive element whereby an alarm is emitted if the strap is cut.

U.S. Pat. No. 5,493,274, issued to Long relates to an alarm configured to resemble a golf club head and is supported on an elongated support stanchion that is placed within the golf bag. The alarm assembly detects movement of the bag and sounds an alarm alerting a user of an attempted theft.

U.S. Pat. No. 5,164,706, issued to Chen, relates to an alarm device for briefcases and handbags. More specifically, the alarm device is a proximity alarm integral with an attachment strap securable to the handbag or briefcase. When activated, the alarm will detect a person or other creature within the detection range thereby emitting an audible signal.

U.S. Pat. No. 5,148,150, issued to White et al, discloses a compact security alarm for a portable container comprising a power unit, an alarm unit, a switch unit, and a sensor unit connected in series. If sudden movement or change of position of the portable container occurs, the sensor unit will activate the alarm unit. The invention also contains a hidden switch on the container whereby the owner can discreetly manipulate the alarm.

U.S. Pat. No. 5,126,719, issued to DeSorbo, discloses a remotely armed alarm system including a motion sensitive alarm disposed in an article that an individual wishes to protect. The alarm is armed in response to a first RF signal from a remote transmitter/controller and disarmed in response to a second RF signal from the transmitter/controller. The alarm produces a continuous or discontinuous sound when the article is moved. The alarm is activated for a predetermined duration after each movement of the article.

Although various theft preventive devices for luggage exist in the prior art, they are activated by motion. Such devices are not practical, however, when the user wishes to check the luggage with a passenger service such as an airline since any movement will activate the alarm. The present invention relates to a device which may be coupled with a valise zipper to audibly alert a remote user upon an unauthorized person tampering with the zipper. Accordingly, incidental or authorized movement of the bag will not activate the alarm.

SUMMARY OF THE INVENTION

The present invention relates to an alarm for a travel bag including an alarm unit that is attached to the bag and a remote unit that is carried by an individual. The alarm unit includes a zipper tongue receptacle into which the zipper tongue is inserted. A key lock on the alarm unit operates an internal latch lever to secure the zipper tongue within the receptacle while simultaneously activating the alarm. If the zipper tongue is removed from the receptacle, an internal alarm circuit is closed thereby emitting an audible alarm. Further, the alarm unit transmits a radio wave signal to a remote unit, emitting a second alarm thereon. The alarms in both units will continue indefinitely until a deactivation button on the remote unit is depressed, thereby opening the alarm circuit.

It is therefore an object of this invention to provided a new and improved alarm for a valise.

Is another object of this invention to provide an alarm for a valise that is activated upon the zipper being opened.

It is still another object of this invention to provide an alarm for a valise which can locally or remotely notify a user that the valise has been opened by an unauthorized user.

It is yet another object of this invention to provide an alarm for a valise in two-way communication with a remote unit, whereby the alarm may be activated or deactivated remotely.

Other objects, features, and advantages of the present invention will become more readily apparent from the following detailed description of the preferred embodiment when considered with the attached drawings and the appended claims.

DESCRIPTION OF THE PREFERRED EMBODIMENT

Figure 1:
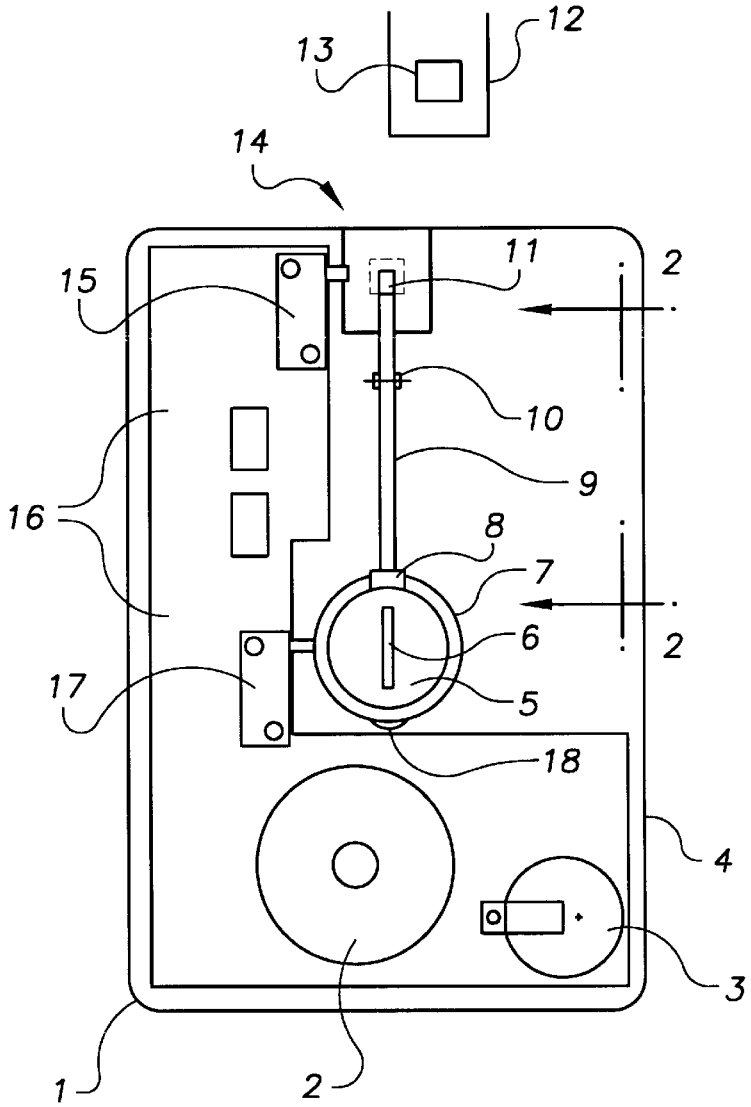
FIG. 1 depicts a cross-sectional view of the alarm unit attached to a travel bag.
Figure 2:
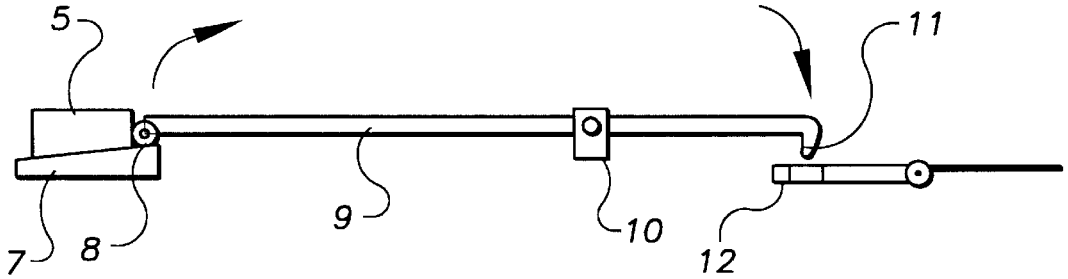
FIG. 2 depicts a side view of the key activated zipper lock according to the present invention.
Figure 3:
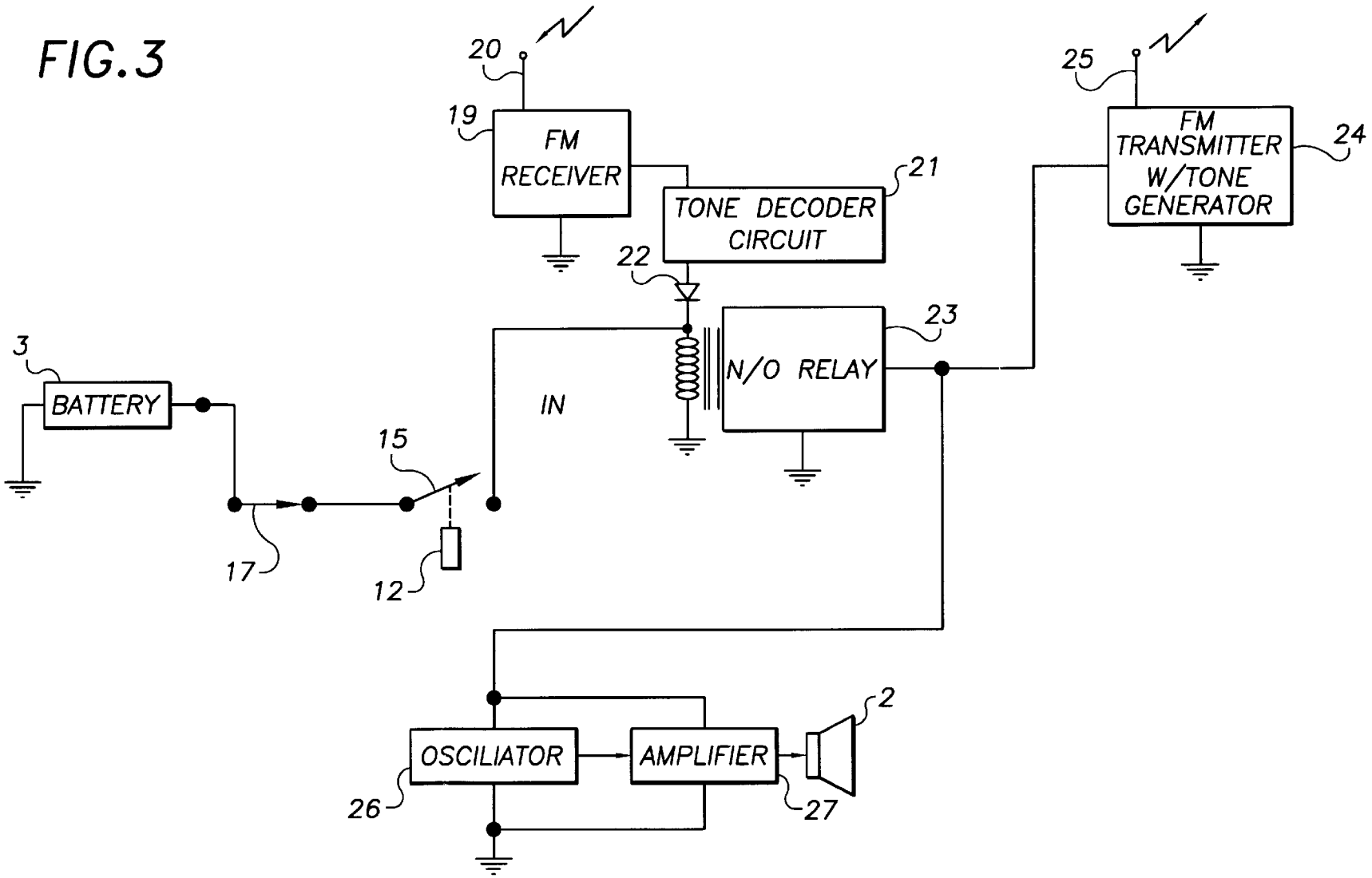
FIG. 3 is an electrical schematic of the circuitry within the alarm unit.

Referring now to FIGS. 1 and 2, the present invention relates to an alarm unit 1 for a valise including an outer case 4, a battery 3, a speaker 2, and an electronic circuit board 16. Disposed on the outer case 4 is key lock 5, having a key port 6 on its outer surface. By inserting a key into the key port and rotating the key, the lock may be moved between a locked and unlocked position. Attached to the key lock is a cam 7 having an upper surface of varying height.

The outer case 4 also includes zipper tongue lock means including a lever 9 pivotally attached to an inside surface of the outer case 4 by use of a spring loaded pivot 10. The lever 9 includes a cam roller 8, at a first end which engages the cam 7. Referring now to FIG. 2, the spring-loaded pivot 10 biases the lever 9, ensuring continual contact between cam roller 8 and the cam 7. The opposing, second end of the lever 9 contains a hook 11, which is received within an opening 13 on the zipper tongue to secure the tongue within a receptacle 14 on the outer case.

The internal electronic circuit board 16 contains a first microswitch 15 and a second microswitch 17. The first microswitch 15 is activated by the insertion of zipper tongue 12 into the receptacle 14 on the alarm casing. The second microswitch 17 is activated by side cam 18, which is fixedly attached to the side of key lock 5. This mechanism is described in further detail below.

Microswitch 15 is normally closed and is opened when zipper tongue 12 inserted into receptacle 14, which opens microswitch 15 to arm the alarm. Microswitch 17 is shown in a closed circuit position.

The alarm circuit board 16 further includes an FM Receiver 19, having an associated antenna 20, a tone decoder circuit 21, a blocking diode 22, and relay 23. Relay 23 is operable in response to a signal from FM Receiver 19, with associated antenna.

If microswitch 15 is closed, such as when the zipper tongue is removed, relay 23 closes thereby activating an FM transmitter 24 which transmits a signal via antenna 25 to a remote receiver 30 described below. In addition, oscillator 26 and amplifier 27 cause speaker 2 to emit an audible alarm, thereby alerting persons nearby and frightening an attempted thief.

Figure 4:
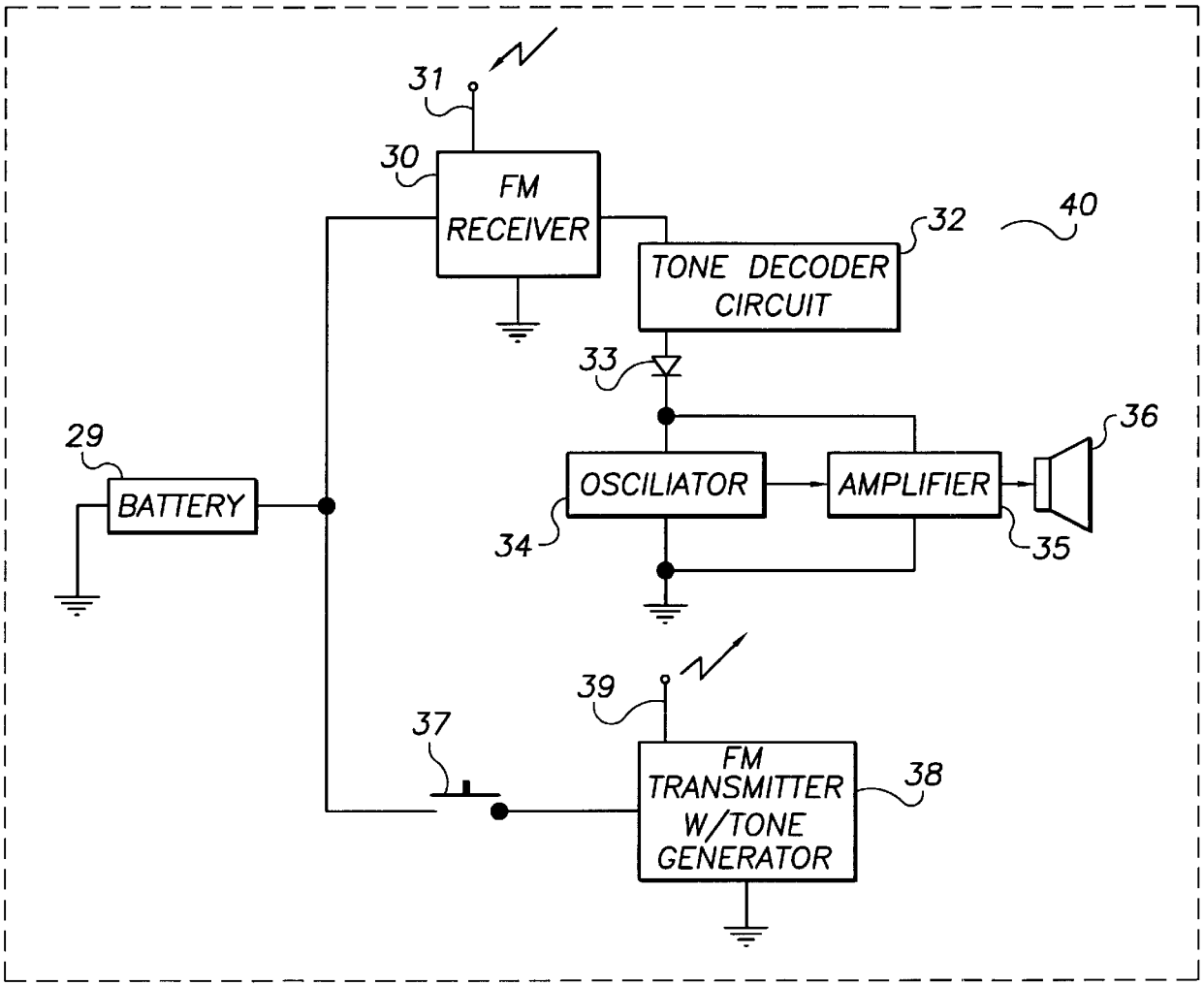
FIG. 4 is an electrical schematic of the circuitry associated within the remote unit.

Referring now to FIG. 4, an electrical block schematic of a remote means 40 is depicted. A battery 29 provides power to both FM transmitter 38 and FM receiver 30. When an activator button 37 is depressed, FM transmitter 38 transmits a discrete signal to the alarm unit via antenna 39. The alarm unit receiver 19 transmits a signal to relay 23 the state of which changes in response to the input signal.

The remote unit receiver 30 receives signals from the alarm unit FM transmitter 24 via associated antenna 31. The signal is relayed through a tone decoder circuit 32, blocking diode 33, oscillator 34 and amplifier 35 which cause an audible alarm to be emitted through a speaker 36 on the remote unit.

Each receiver and transmitter are responsive to a specific wavelength. Tone decoder circuits 21 and 32 recognize only the wavelengths associated with its corresponding unit, and therefore, in effect, serve as "filters" by not allowing other alarm units or remote units to interfere with operation of the present unit.

In use, the alarm outer casing 4 is attached to an outer surface of a suitcase, a backpack, a portable bag or similar storage means which utilize zipper type closures. After a person zips shut the container, he or she places the zipper tongue 12 into the receptacle 14. Zipper tongue 12 should be inserted when key lock 5 is in such a position that cam roller 8 is not resting on the highest elevation of the cam 7. When zipper tongue 12 is inserted into receptacle 14, zipper tongue engages microswitch 15 placing it in an electrically open position.

Next, a user rotates lock 5 with the key causing side cam 18 to engage microswitch 17, thereby closing the circuit. In addition, when key lock 5 is rotated to a locked position, the highest elevation of cam surface 7 is immediately beneath cam roller 8 thereby pivoting lever 9, until hook 11 is inserted into aperture 13 on zipper tongue 12. With minimal manipulation, a person can ensure that hook 11 is tightly secured within zipper tongue aperture.

A user then depresses activator button 37 on the remote unit 40 whereby transmitter 38 transmits a signal to FM receiver 19. FM receiver 19 provides an input signal to relay 23, which opens and the alarm unit 1 is then "armed."

If an individual removes zipper tongue 12 from the receptacle 14 while the system is armed, microswitch 15 will close, thereby closing the circuit. At that time, an audible alarm will be emitted through speakers, thereby deterring or preventing further tampering attempts by a potential thief. In addition, power will be provided to FM transmitter 24, which will send a signal to FM receiver 30, causing remote unit 40 to emit an audible alarm as previously described.

The present invention is not to be limited to the exact details of construction enumerated above. For example, although the device has been described as being designed for valises, the device may be used on any type zip up bag, case or similar enclosure.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An alarm for a portable storage device, said device having a zipper closure means with a zipper tongue, the alarm comprising:

a case attached to said portable storage device, said case including a receptacle for receiving said zipper tongue;

an activation means for detecting removal of said tongue from said receptacle;

a first alarm means in communication with said activation means for emitting an audible alarm upon removal of said tongue from said receptacle.

2. A device according to claim 1 further comprising a remote means having a second alarm means thereon in communication with said activation means for audibly alerting a remote user that said tongue has been removed from said receptacle.

3. A device according to claim 2 wherein said remote means further includes a transmission means in communication with a receiver means within said case, said receiver means in communication with said first alarm means and said activation means whereby a user may remotely activate and deactivate said first alarm means.

4. A device according to claim 1 wherein said activation means comprises:

a locking means for locking said zipper tongue within said receptacle;

a first switch means in communication with said locking means, said switch means activated when said zipper tongue is locked within said receptacle;

a second, normally closed switch means received within said receptacle and in communication with said first alarm means and said first switch means, said second switch means moving to an open position when said tongue is inserted into said receptacle whereby removal of said tongue places said second switch means in a closed position thereby activating said first alarm means.

5. An alarm for a portable storage device, said portable device having a zipper closure means with a zipper tongue, the alarm comprising:

a case attached to said portable storage device, said case including a receptacle for receiving said zipper tongue;

a lock means within said receptacle for locking said tongue within said receptacle, said lock means movable between a locked and unlocked position;

a first switch means that is activated when said lock means is placed in the locked position;

a second, normally closed switch means in communication with said first switch means and positioned within said receptacle so as to move to an open position when said tongue is inserted therein;

a first audible alarm means in communication with said second switch means that emits an audible signal upon said tongue being removed from said receptacle.

6. A device according to claim 5 further comprising:

a transmission means in communication with said second switch means for transmitting a discrete signal;

a remote means including a receiver means for receiving a signal from said transmission means;

a second alarm means in communication with said remote receiver means for emitting a signal upon said receiver means receiving a signal from said transmission means.

7. A device according to claim 6 wherein said remote means further comprises:

a transmission means in selective communication with a receiver means within said case, said receiver means in communication with said first alarm means allowing a user to remotely activate and deactivate said first alarm means.

* * * * *